US010591117B2

(12) United States Patent
Sinphay

(10) Patent No.: US 10,591,117 B2
(45) Date of Patent: Mar. 17, 2020

(54) LUMINAIRE HOUSING HAVING ADJUSTABLE DIMENSION

(71) Applicant: Hubbell Incorporated, Shelton, CT (US)

(72) Inventor: Anthony Sinphay, Greenville, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/934,495

(22) Filed: Mar. 23, 2018

(65) Prior Publication Data

US 2018/0274741 A1 Sep. 27, 2018

Related U.S. Application Data

(60) Provisional application No. 62/476,212, filed on Mar. 24, 2017.

(51) Int. Cl.

| | |
|---|---|
| ***F21V 17/02*** | (2006.01) |
| ***F21S 2/00*** | (2016.01) |
| ***F21V 15/01*** | (2006.01) |

(52) U.S. Cl.

CPC ..... *F21S 2/005* (2013.01); *F21V 15/01* (2013.01); *F21V 15/012* (2013.01)

(58) Field of Classification Search

CPC ... F21K 9/00; E01F 9/582; E01F 9/594; F21S 8/02; F21S 8/022; F21S 8/024; F21S 8/026; F21S 8/028; F21V 5/04; F21V 14/02; F21V 15/00; F21V 17/02; F21V 19/02; F21V 21/04; F21V 21/22; F21V 23/008; F21V 15/012; F21V 15/01; F21Y 2105/10; F21Y 2115/10; A47B 45/00

See application file for complete search history.

(56) References Cited

U.S. PATENT DOCUMENTS

| | | | | | |
|---|---|---|---|---|---|
| 1,120,955 | A * | 12/1914 | Martin | B65D 5/0005 | 220/8 |
| 1,380,024 | A * | 5/1921 | Sachnoff | A47B 61/02 | 312/205 |
| 2,592,461 | A * | 4/1952 | Perkins | B63C 9/21 | 116/202 |
| 3,523,702 | A * | 8/1970 | Unti | A47B 9/14 | 108/106 |

(Continued)

*Primary Examiner* — Ismael Negron

(74) *Attorney, Agent, or Firm* — Michael Best & Friedrich, LLP

(57) ABSTRACT

A luminaire includes a first housing portion having a first knockout, a second housing portion having a second knockout, first and second apertures formed in one of the first and second housing portions, and at least one protrusion formed in the other of the first and second housing portions. The first housing portion and the second housing portion are selectively connectable to one another in a first configuration by the at least one protrusion received within the first aperture, and a second configuration by the at least one protrusion received within the second aperture. An upper surface of the first housing portion and a lower surface of the second housing portion are spaced apart by a first distance in the first configuration with the knockouts forming a first shape, and by a second distance in the second configuration with the knockouts forming a second shape.

20 Claims, 6 Drawing Sheets

(56) References Cited

U.S. PATENT DOCUMENTS

| | | | | | |
|---|---|---|---|---|---|
| 4,562,520 | A * | 12/1985 | Chapman | F21S 6/006 | 248/289.11 |
| 4,941,716 | A * | 7/1990 | Rome | A47B 45/00 | 312/205 |
| 5,155,667 | A * | 10/1992 | Ho | B60Q 7/00 | 362/190 |
| 5,192,019 | A * | 3/1993 | Meehan | B65D 5/0005 | 220/8 |
| 5,223,673 | A * | 6/1993 | Mason | H02G 3/16 | 174/53 |
| 5,421,646 | A * | 6/1995 | McNamara | A47B 45/00 | 108/102 |
| 5,490,050 | A * | 2/1996 | Clark | F21L 15/04 | 362/200 |
| 5,664,630 | A * | 9/1997 | Meyer | A62C 37/08 | 169/37 |
| 7,012,806 | B2 * | 3/2006 | Jones | G06F 1/1616 | 165/104.11 |
| 7,152,710 | B1 * | 12/2006 | Huang | B60Q 1/2688 | 181/227 |
| 8,118,463 | B2 * | 2/2012 | Owen | F21V 5/00 | 362/120 |
| 8,905,583 | B2 * | 12/2014 | Dubord | F21S 2/005 | 174/653 |
| 9,787,073 | B1 * | 10/2017 | Townsend | H02G 3/121 | |
| 9,885,460 | B2 * | 2/2018 | Tang | F21V 7/0066 | |
| 2004/0120141 | A1 * | 6/2004 | Beadle | F21S 8/024 | 362/147 |
| 2015/0119708 | A1 * | 4/2015 | Sachse | A61B 5/0071 | 600/431 |
| 2015/0173508 | A1 * | 6/2015 | Ma | A47B 45/00 | 211/208 |

* cited by examiner

LUMINAIRE HOUSING HAVING ADJUSTABLE DIMENSION

CROSS-REFERENCE TO RELATED APPLICATIONS

This application claims priority to, prior-filed U.S. Provisional Patent Application No. 62/476,212, filed. Mar. 24, 2017, the entire content of which is incorporated herein by reference.

BACKGROUND

The present disclosure relates to the field of luminaires, and particularly to luminaire housings.

SUMMARY

In one aspect, a luminaire includes a first housing portion and a second housing portion. The first housing portion includes an upper surface and a plurality of walls. The second housing portion includes a lower surface and a plurality of walls, and the lower surface includes a lens portion. The first housing portion and the second housing portion are selectively connectable to one another in a first configuration in which the upper surface of the first housing portion and the lower surface of the second housing portion are spaced apart by a first distance. The first housing portion and the second housing portion are selectively connectable to one another in a second configuration in which the upper surface of the first housing portion and the lower surface of the second housing portion are spaced apart by a second distance that is different from the first distance.

In another aspect, a luminaire includes a first housing portion and a second housing portion. The first housing portion includes an upper surface and a plurality of walls, and at least one of the plurality of walls includes a first knockout. The second housing portion includes a lower surface and plurality of walls, and the lower surface includes a lens portion. At least one of the plurality of walls of the second housing portion includes a second knockout. The first housing portion and the second housing portion are selectively connectable to one another in a first configuration in which the first knockout is aligned with the second knockout to form a first knockout shape. The first housing portion and the second housing portion are selectively connectable to one another in a second configuration in which the first knockout overlaps with the second knockout to form a second knockout shape different than the first knockout shape.

Other aspects will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Terms of degree, such as "substantially" or "approximately" are understood by those of ordinary skill to refer to reasonable ranges outside of the given value, for example, general tolerances associated with manufacturing, assembly, and use of the described embodiments.

Figure 1:
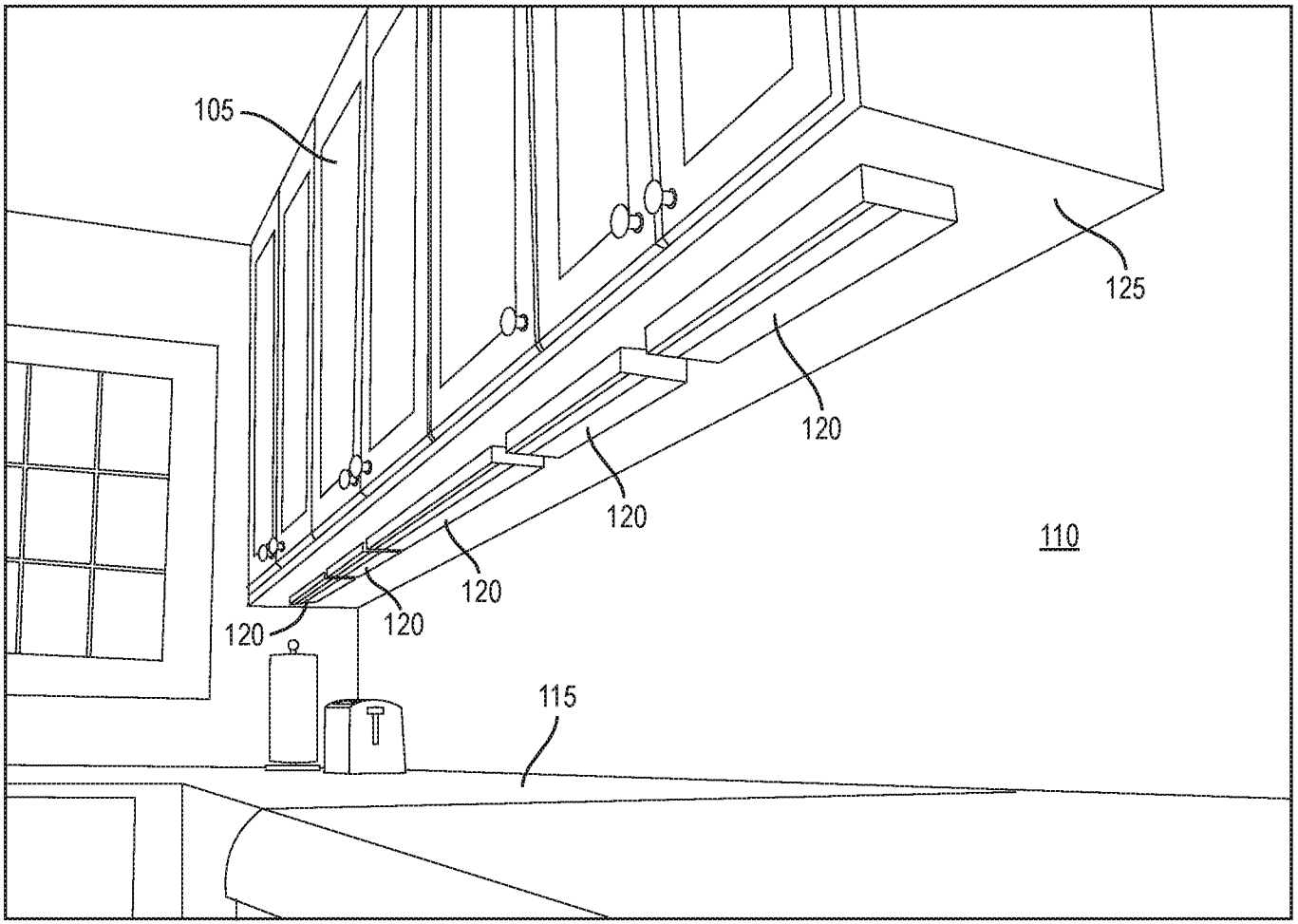
FIG. 1 illustrates a height adjustable luminaire positioned underneath a cabinet.

FIG. 1 illustrates a cabinet 105 secured to a wall HO above a countertop 115. A luminaire 120 is coupled to a lower surface 125 of the cabinet 105 to illuminate the countertop 115 and a portion of the wall 110 located between the countertop 115 and the cabinet 105. In the illustrated embodiment, cabinet 105 is positioned in a kitchen; however, in other embodiments, the cabinet 105 may be located in another type of room (e.g., bathroom, garage, basement, dining room, etc.). The cabinet 105 may be located in a variety of properties (e.g., residential, individual business offices, common business areas, etc.).

Figure 2:
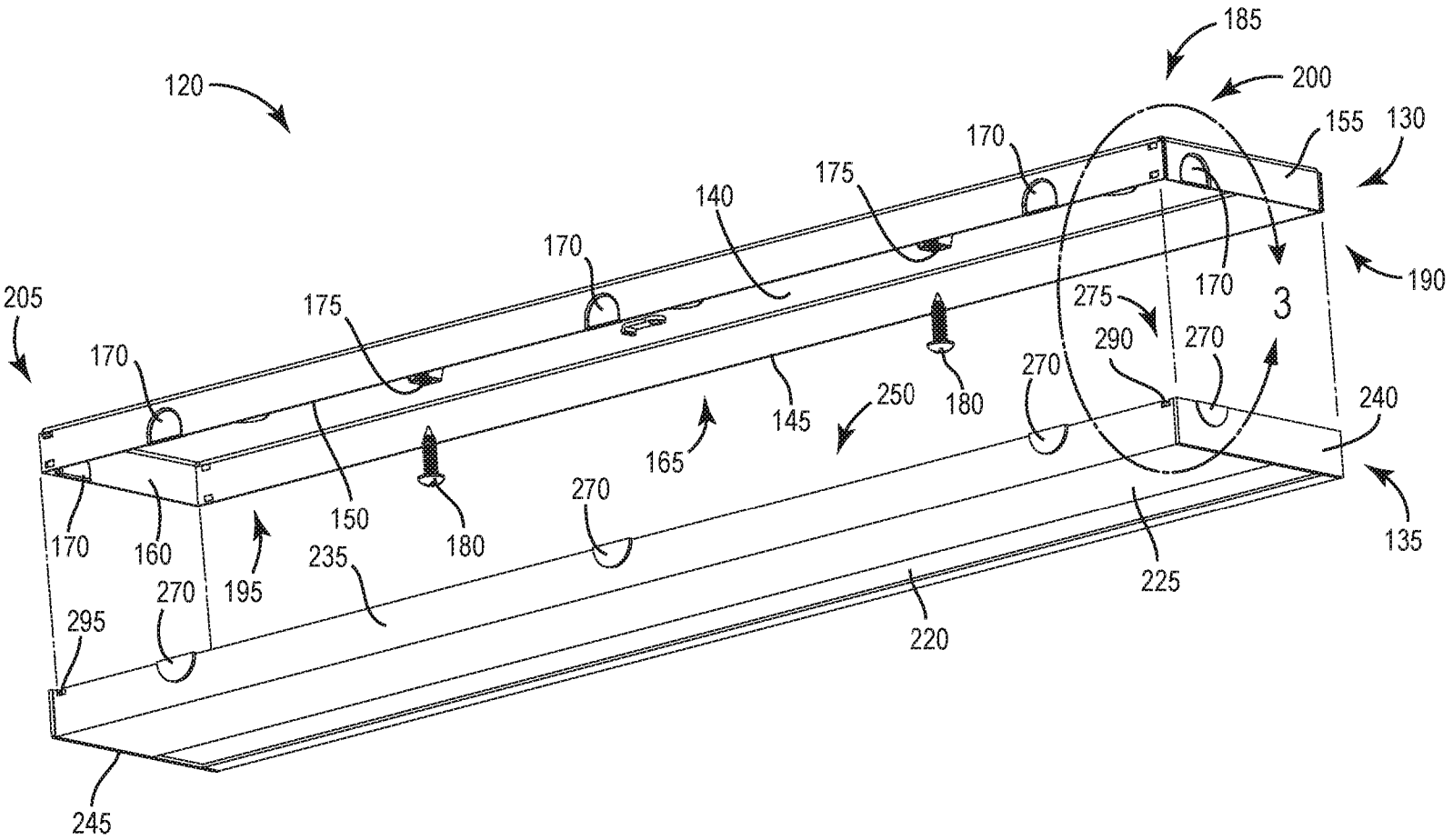
FIG. 2 is an exploded view of the height adjustable luminaire of FIG. 1 including an upper housing and a lower housing.

As best shown in FIG. 2, the luminaire 120 includes an upper housing 130 and a lower housing 135. The illustrated upper housing 130 includes an upper wall 140, a front wall 145 oriented perpendicular to the upper wall 140, a back wall 150 oriented parallel to the front wall 145, a first side wall 155 extending between the front wall 145 and the back wall 150, and a second side wall 160 also extending between the front wall 145 and the back wall 150. The upper wall 140, the front wall 145, the back wall 150, the first side wall 155, and the second side wall 160 collectively define an upper cavity 165. The front wall 145, the back wall 150, the first side wall 155, and the second side wall 160 define an upper housing height. In the illustrated embodiment, the height is less than about 0.57 inches.

The upper housing 130 also includes a plurality of semicircular upper knockouts 170 formed on the back wall 150, the first side wall 155, and the second side wall 160 and are selectively removable from the upper housing 130. In the illustrated embodiment, the back wall 150 includes three upper knockouts 170 that extend into the upper cavity 165 and toward the front wall 145, the first side wall 155 includes one upper knockout 170 that extends into the upper cavity 165 and toward the second side wall 160, and the second side wall 160 includes one upper knockout 170 that extends into the upper cavity 165 and toward the first side wall 155. The front wall 145 does not include any upper knockouts 170. In one embodiment, the first side wall 155 and the second side wall 160 may include more than one upper knockout 170, the back wall 150 may include more or less than three upper knockouts 170, and the front wall 145 may include at least one upper knockout 170. In other embodiments, one or more of the upper knockouts 170 may extend out of the upper cavity 165 and away from an opposing wall, or the upper knockouts 170 may be substantially flush with the corresponding wall. In further embodiments, the upper knockouts 170 may be of a different geometry (e.g., square, rectangle, triangle, etc.). Furthermore, the illustrated upper wall 140 includes fastener apertures 175 extending therethrough that are each sized to receive a fastener 180. In one embodiment, the fasteners 180 are pre-installed to the upper housing 130.

With continued reference to FIG. 2, the upper housing 130 also includes a plurality of upper apertures 185 formed in the front wall 145 and the back wall 150. For example, the front wall 145 includes a first pair of upper apertures 190 located near an end of the front wall 145 adjacent the first side wall 155, and the front wall 145 includes a second pair of upper apertures 195 located near an end of the front wall 145 adjacent the second side wall 160. Likewise, the back wall 150 includes a third pair of upper apertures 200 located near an end of the back wall 150 adjacent the first side wall 155 (FIG. 3), and the back wall 150 includes a fourth pair of upper apertures 205 located near an end of the back wall 150 adjacent the second side wall 160. In other embodiments, the plurality of upper apertures 185 may be also formed in the first side walls 155 and the second side walls 160, may be exclusively formed in the first side walls 155 and the second side walls 160, or may be formed in a combination of the front wall 145, the back wall 150, the first side wall 155, and/or the second side wall 160. The illustrated pairs of upper apertures 190, 195, 200, 205 each include a first aperture 210 and a second aperture 215 (FIG. 3) that align in a direction perpendicular to the upper wall 140 so that the second aperture 215 is located closer to the upper wall 140 than the first aperture 210. The illustrated first aperture 210 and the second aperture 215 are formed both as a square aperture. In other embodiments, the first aperture 210 and the second aperture 215 may be of a different geometry (e.g., rectangle, triangle, circle, etc.). In further embodiments, the plurality of upper apertures 185 may include more or less than the first aperture 210 and the second aperture 215.

Figure 4:
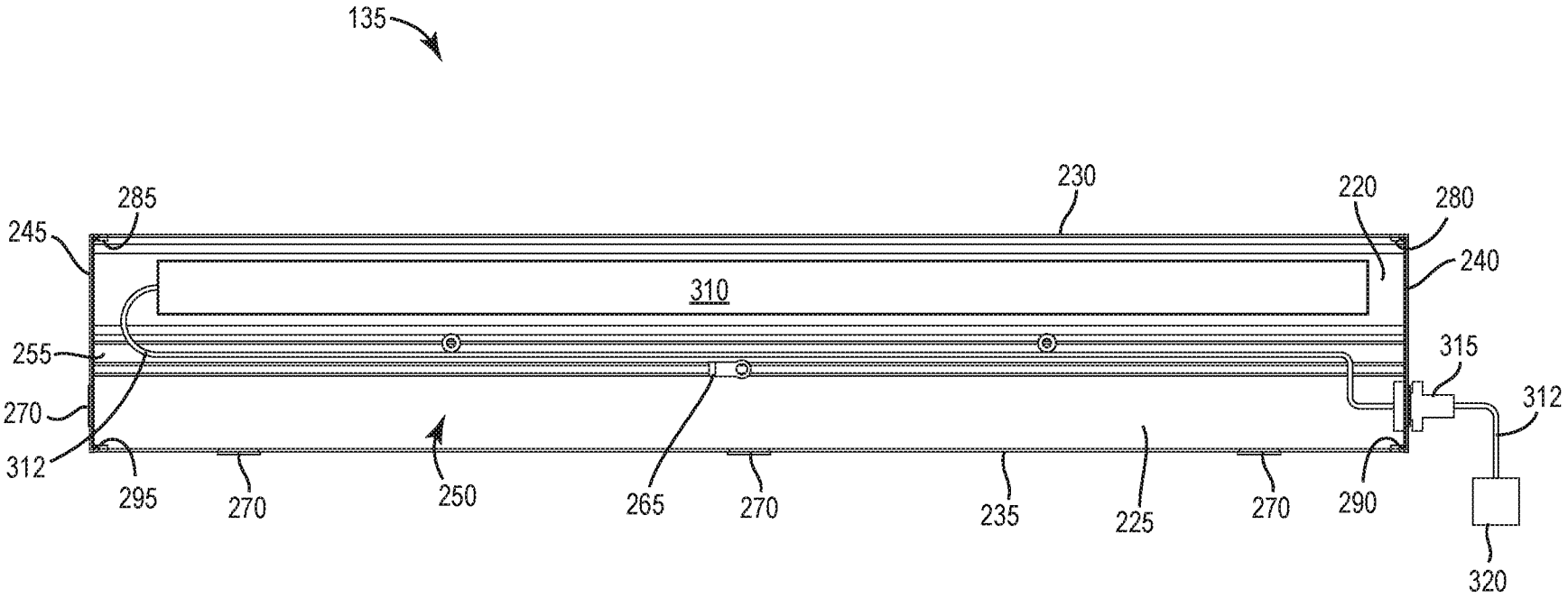
FIG. 4 is a plan view of the lower housing of FIG. 2 including a fitting coupled to the lower housing and a light source coupled to a power source.

With reference back to FIG. 2, the illustrated lower housing 135 includes an optic or lens, which may include a translucent or transparent member 220 (e.g., glass or plastic material), coupled to a lower wall 225 of the lower housing 135. The lower housing 135 also includes a front wall 230 (FIG. 4) oriented perpendicular to the lower wall 225, a back wall 235 oriented parallel to the front wall 230, a first side wall 240 extending between the front wall 230 and the back wall 235, and a second side wall 245 also extending between the front wall 230 and the back wall 235. The lower wall 5, the front wall 230, the back wall 235, the first side wall 240, and the second side wall 245 collectively define a lower cavity 250 (FIG. 4). As best shown in FIG. 4, the illustrated lower wall 225 includes a channel 255 extending between the first side wall 240 and the second side wall 245. The channel 255 is sized to receive electrical wires positioned within the lower cavity 250, and a bracket 265 is secured to the lower wall 225 and moveable over the channel 255 to contain the electrical wires received therein. The front wall 230, the back wall 235, the first side wall 240, and the second side wall 245 define a lower housing height. In the illustrated embodiment, the lower housing height is less than about 0.57 inches.

The lower housing 135 also includes a plurality of semicircular lower knockouts 270 formed on the back wall 235, the first side wall 240, and the second side wall 245 and are selectively removable from the lower housing 135. In the illustrated embodiment, the back wall 235 includes three lower knockouts 270 that extend out of the lower cavity 250 and away from the front wall 230, the first side wall 240 includes one lower knockout 270 that extends out of the lower cavity 250 and away from the second side wall 245, and the second side wall 245 includes one lower knockout 270 that extends out of the lower cavity 250 and away from the first side wall 240. The front wall 230 does not include any lower knockouts 270. In one embodiment, the first side wall 240 and the second side wall 245 may include more than one lower knockout 270, the back wall 235 may include more or less than three lower knockouts 270, and the front wall 230 may include at least one lower knockout 270. In other embodiments, one or more of the lower knockouts 270 may extend into the lower cavity 250 and toward an opposing wall, or the lower knockouts 270 may be substantially flush with the corresponding wall. In further embodiments, the lower knockouts 270 may be of a different geometry (e.g., square, rectangle, triangle, etc.).

Figure 3:
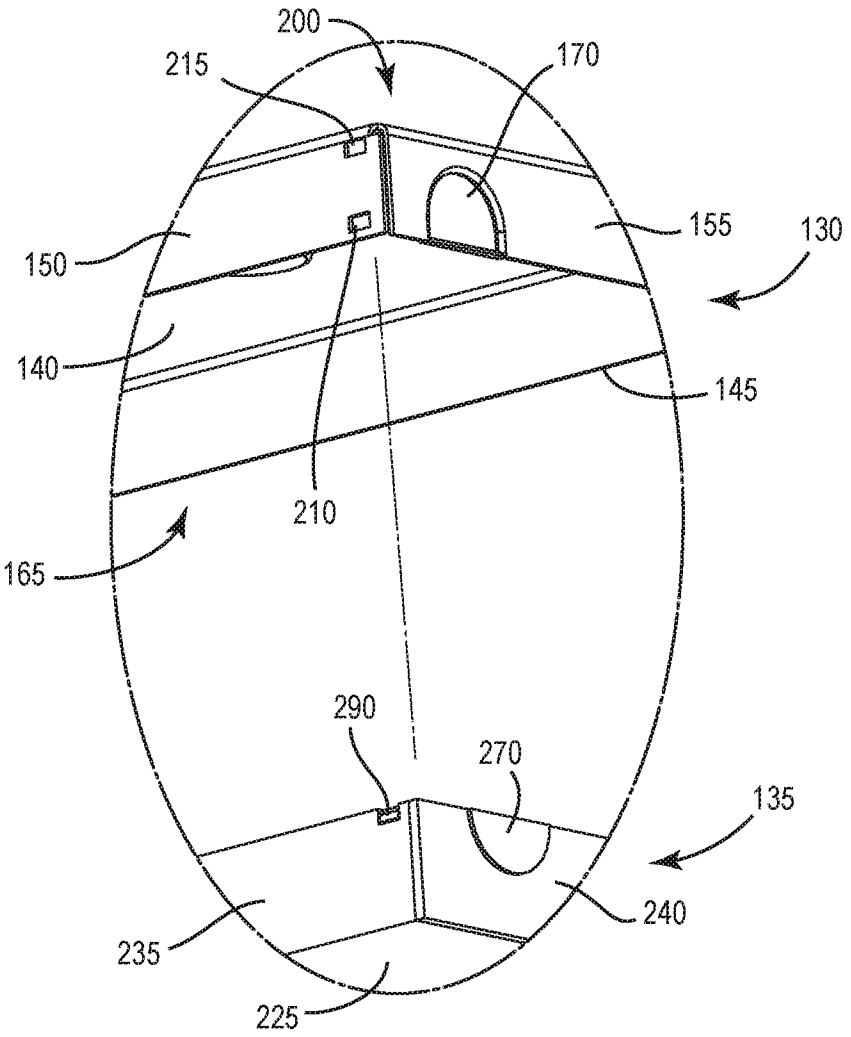
FIG. 3 is a detailed view of the upper housing and the lower housing of FIG. 2.

With reference to FIGS. 2 and 3, the lower housing 135 also includes a plurality of protrusions 275 extending from the front wall 230 and the back wall 235. For example, the front wall 145 includes a first protrusion 280 (FIG. 4) located near an end of the front wall 230 adjacent the first side wall 240, and the front wall 230 includes a second protrusion 285 (FIG. 4) located near an end of the front wall 230 adjacent the second side wall 245. Likewise, the back wall 235 includes a third protrusion 290 located near an end of the back wall 235 adjacent the first side wall 240, and the back wall 235 includes a fourth protrusion 295 located near an end of the back wall 235 adjacent the second side wall 245. The illustrated plurality of protrusions 275 are sized to be received within the plurality of upper apertures 185 of the upper housing 130. In other embodiments, the plurality of protrusions 275 may also extend from the first side walls 240 and the second side walls 245, may exclusively extend from the first side walls 240 and the second side walls 245, or may extend from a combination of the front wall 230, the back wall 235, the first side wall 240, and/or the second side wall 245. In further embodiments, the plurality of protrusions 275 may be coupled to the upper housing 130 and the plurality of apertures 185 may be formed in the lower housing 135. The illustrated protrusions 280, 285, 290, 295 extend from the front wall 230 and back wall 235 toward the lower cavity 250. In other embodiments, the protrusions 280, 285, 290, 295 may extend from the front wall 230 and back wall 235 away from the lower cavity 250.

Figure 5:
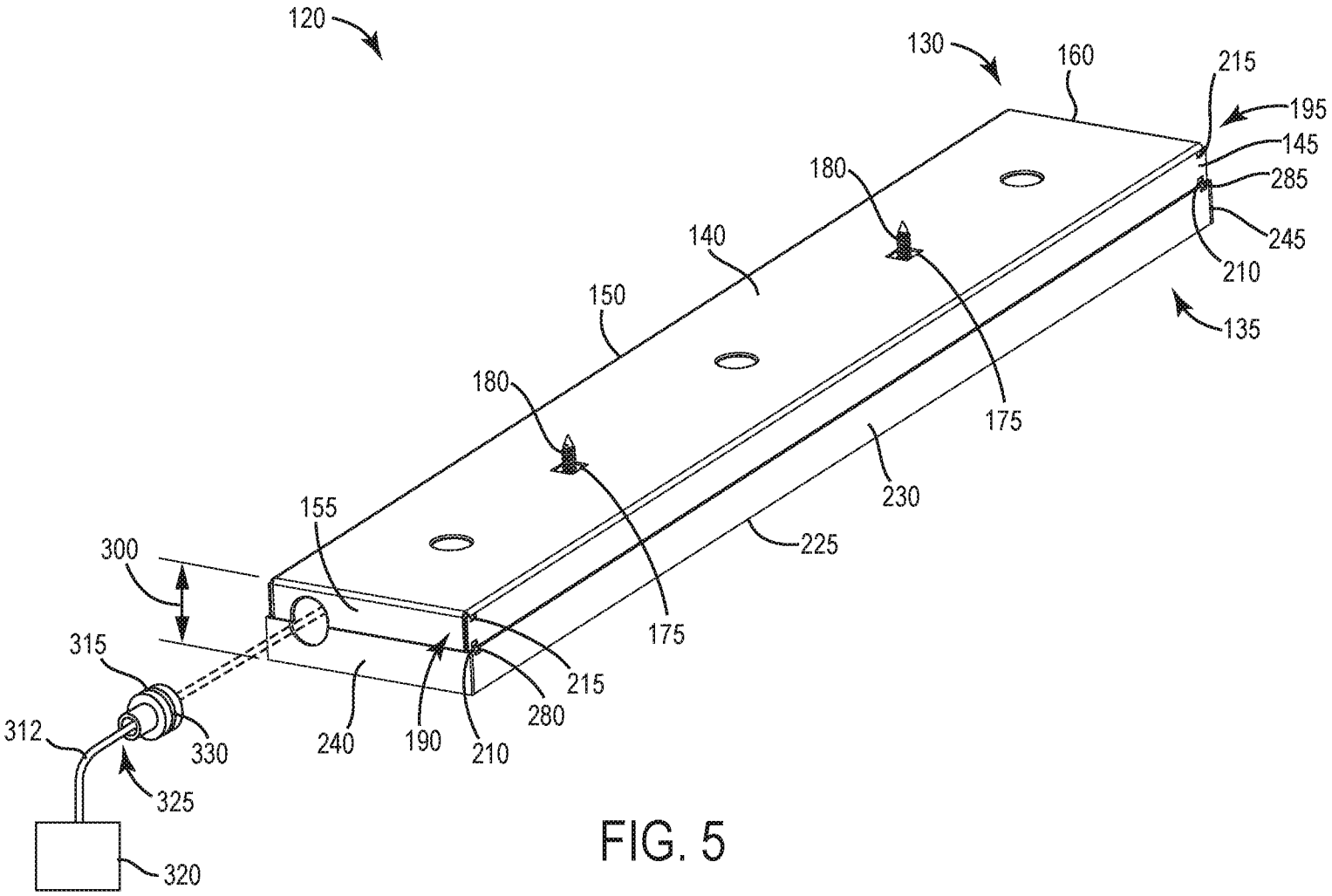
FIG. 5 is a perspective view of the height adjustable luminaire of FIG. 1 in a first configuration.
Figure 6:
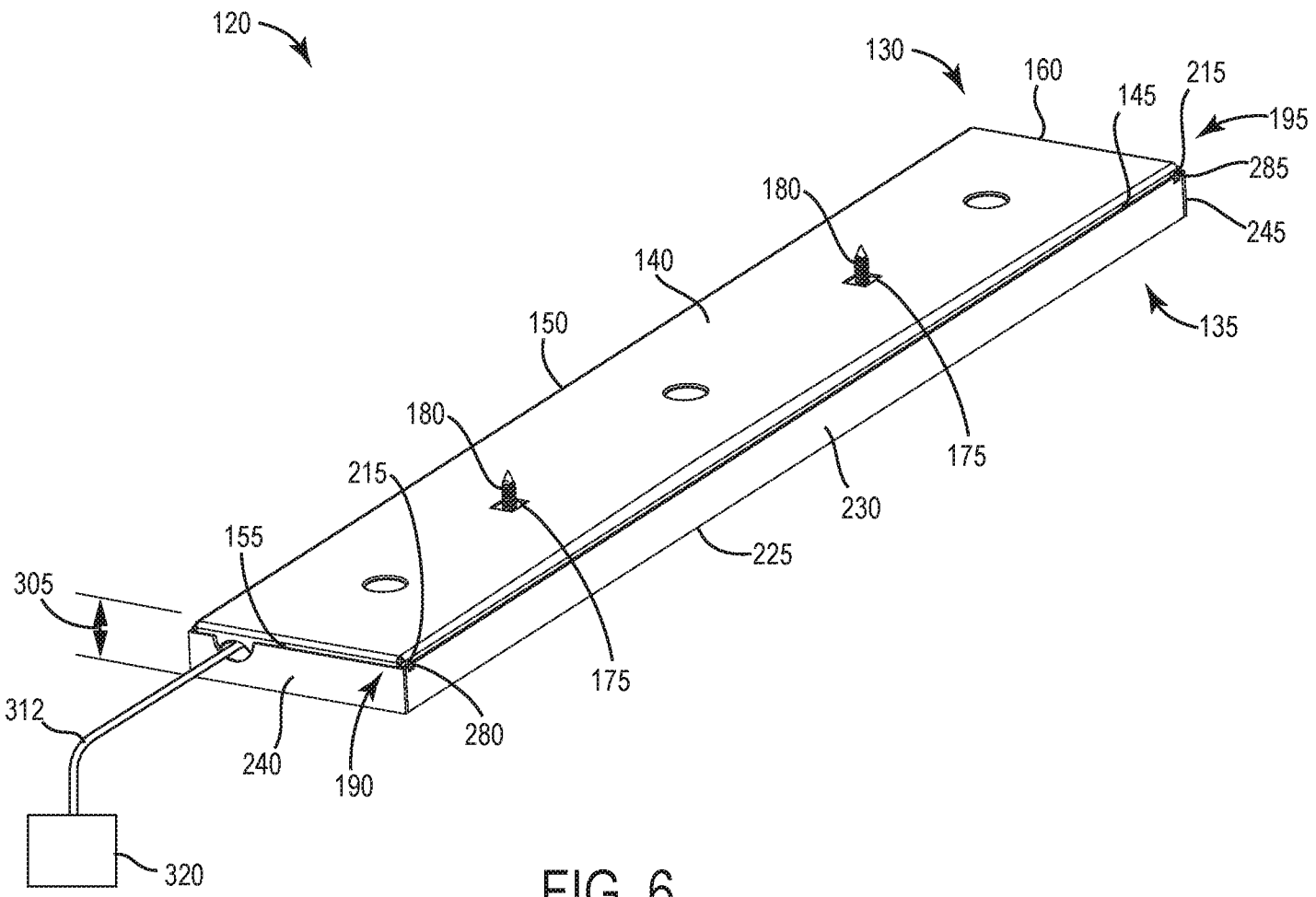
FIG. 6 is a perspective view of the height adjustable luminaire of FIG. 1 in a second configuration.

The upper and lower housings 130, 135 are selectively coupled together in a first configuration (FIG. 5) or a second configuration (FIG. 6). In the first configuration, the upper housing 130 is partially inserted into the lower cavity 250 so that each of the plurality of upper apertures 185 aligns with a corresponding one of the plurality of protrusions 275. As the lower and upper housings 135, 130 are pushed toward each other, the plurality of protrusions 275 initially engage the front and back walls 145, 150 of the upper housing 130. Such an engagement biases the front walls 145, 230 and the back walls 150, 235 away from each other for the plurality of protrusions 275 to slide into the first apertures 210. Once the protrusions 275 are received within the first apertures 210, the upper knockouts 170 align with the lower knockouts 270 to generally form a circular knockout. The first configuration of the luminaire 120 is defined by a first height 300 between the upper wall 140 of the upper housing 130 and the lower wall 225 of the lower housing 135. In the illustrated embodiment, the first height 300 is about 0.96 inches. In other embodiments, the first height 300 is about 1 inch.

By further pushing the upper and lower housings 130, 135 together, the plurality of protrusions 275 slide out of the first apertures 210 to reengage the front walls 145 and the back walk 150 of the upper housing 130 for the luminaire 120 to be positioned in the second configuration (FIG. 6). Such an engagement again biases the front walls 145, 230 and the back walls 150, 235 away from each other for the plurality of protrusions 275 to slide toward and into the second apertures 215. Once the protrusions 275 are received within the second apertures 215, the upper knockouts 170 generally overlap with the lower knockouts 270 to form a non-circular knockout (e.g., ellipse). The second configuration of the luminaire 120 is defined by a second height 305 between the upper wall 140 of the upper housing 130 and the lower wall 225 of the lower housing 135. In the illustrated embodiment, the second height 305 is about 0.572 inches. In other embodiments, the second height 305 is less than 1 inch.

To assemble the luminaire 120 to cabinet 105, the upper housing 130 is secured in a desired location on the lower surface 125 of the cabinet 105 by driving the fasteners 180 through the fastener apertures 175 and the lower surface 125. With reference to FIG. 4, a light source (e.g., an LED) 310 is positioned within the lower cavity 250 of the lower housing 135 and electrical wires 312 are coupled to the light source 310 while the lower housing 135 is supported on the countertop 115. In some instances, at least one fitting 315 (FIG. 4) is coupled to the luminaire 120 to direct the electrical wires 312 from within the luminaire 120 to a power source 320 located outside of the luminaire 120. The fitting 315 includes an internal passageway 325 (FIG. 5) through which the electrical wires 312 extend and an outer circumferential groove 330. To couple the fitting 315 to the luminaire 120, a desired pair of upper and lower knockouts 170, 270 are removed from the upper and lower housings 130, 135. A lower portion of the fitting 315 is then positioned in a semi-circular void left by the removed lower knockout 270 so that the groove 330 receives a portion of the wall that included the lower knockout 270. For example, if one of the lower knockouts 270 of the back wall 235 was removed, then the groove 330 of the fitting 315 would receive a portion of the back wall 235.

After the fitting 315 is positioned on the lower housing 135, the lower housing 135 is raised from the countertop 115 toward the cabinet 105 to be coupled to the upper housing 130. In particular, an upper portion of the fitting 315 is positioned in a semi-circular void left by the removed upper knockout 170 so that the groove 330 receives a portion of the wall that included the upper knockout 170. In the example above, the lower knockout 270 of the back wall 235 is removed and the corresponding upper knockout 170 of the back wall 150 is also removed so that the groove 330 of the fitting 315 would receive a portion of the back wall 150. The lower housing 135 is then snapped into engagement with the upper housing 130 in the first configuration (FIG. 5). As such, the fitting 315 is secured between the upper housing 130 and the lower housing 135 when the luminaire 120 is positioned in the first configuration (the fitting 315 is exploded from the luminaire 120 within FIG. 5 to illustrate the void created by removing the upper and lower knockouts 170, 270).

With reference to FIG. 6, in other instances, the fitting 315 is omitted from the luminaire 120 and the luminaire 120 is assembled to the cabinet 105 in the second configuration. In the second configuration, the semi-circular voids left by the removed pair of upper and lower knockouts 170, 270 provide a passageway for the electrical wires 312, which are coupled to the light source 310, to extend from inside the luminaire 120 to the power source 320 outside the luminaire 120. After the electrical wires 312 are positioned within the void left by the lower knockout 270, the lower housing 135 is raised from the countertop 115 toward the cabinet 105 to be coupled to the upper housing 130. In one embodiment, a rubber or plastic bushing is coupled between the upper and lower housing 130, 135 within the voids left by the upper and lower knockouts 170, 270 to protect the electric wires 312 extending through the upper and lower housings 130, 135. The lower housing 135 is then snapped into engagement with the upper housing 130 in the second configuration (FIG. 6).

In one embodiment, the luminaire 120 includes a control system for an operator to control and tune a correlated color temperature (CCT) of the light source 310. For example, the operator can select from multiple CCTs. The control system can also provide warm dimming to the light source 310. For example, as the light source 310 dims, the CCT changes.

The control system can also include motion sensing capabilities. For example, the control system can detect ambient far field motion (e.g., movement away from the countertop 115) to activate the light source 310, and/or the control system can detect movement in a specific near field area (e.g., movement on or near the countertop 115). In one embodiment, the control system can detect movement using a microwave sensor.

The control system can further include capacitive sensing buttons for an operator to control functionality of the luminaire 120 (e.g., the operator can touch the capacitive sensing buttons to selectively tune the CCT of the light source 310). The capacitive sensing buttons can also signal the control system to operate different functions of the luminaire 120 upon different touch gestures from the operator. The control system can also be coupled to a hands-free activation system (e.g., a toe kick activation switch) located near a floor level of the countertop 115. The toe kick activation switch activates the light source 310 when the operator positions their foot near the toe kick activation switch.

Furthermore, the luminaire 120 can include modular accessory capacity to allow for the addition or to change accessories from the luminaire 120. For example, a USB modular charging port can be selectively coupled to the luminaire 120, an occupancy modular sensor can be selectively coupled to the luminaire 120, and/or a touch modular sensor can be selectively coupled to the luminaire 120.

In addition, the luminaire 120 can include a USB charging port located on either the upper housing 130 and/or the lower housing 135 to charge electronic devices (e.g., phones, tablets, etc.

Although aspects have been described in detail with reference to certain preferred embodiments, variations and modifications exist within the scope and spirit of one or more independent aspects as described.

What is claimed is:

1. A luminaire comprising:

a first housing portion including an upper surface and a plurality of walls;

a second housing portion including a lower surface and a plurality of walls, the lower surface including a lens portion;

a protrusion formed on a first wall of the plurality of walls of one of the first and second housing portions; and first and second apertures formed on a second wall of the plurality of walls of the other one of the first and second housing portions, wherein the protrusion is receivable within the first aperture to couple the first housing portion and the second housing portion in a first configuration in which the upper surface of the first housing portion and the lower surface of the second housing portion are spaced apart by a first distance, and wherein the protrusion is receivable within the second aperture to couple the first housing portion and the second housing portion in a second configuration in which the upper surface of the first housing portion and the lower surface of the second housing portion are spaced apart by a second distance that is different from the first distance.

2. The luminaire of claim 1, wherein the upper surface of the first housing portion includes at least one aperture sized and configured to receive a fastener to secure the first housing portion to a surface of a cabinet independently from the second housing portion.

3. The luminaire of claim 1, wherein the second distance is less than 1 inch.

4. The luminaire of claim 3, wherein the first distance is about 1 inch.

5. The luminaire of claim 1, wherein the first housing portion includes the first and second apertures.

6. The luminaire of claim 5, wherein the protrusion is one of a plurality of protrusions formed on the first wall of the second housing portion.

7. The luminaire of claim 6, wherein the first aperture is one of a plurality of first apertures and the second aperture is one of a plurality of second apertures, and wherein the plurality of second apertures is located between the plurality of first apertures and the upper surface of the first housing portion, and wherein the first housing portion and the second housing portion are in the first configuration while the plurality of protrusions is positioned within the plurality of first apertures, and wherein the first housing portion and the second housing portion are in the second configuration while the plurality of protrusions is positioned within the plurality of second apertures.

8. The luminaire of claim 1, wherein at least one of the plurality of walls of the first housing portion includes an upper knockout, and wherein the upper knockout is selectively removable from the first housing portion.

9. The luminaire of claim 8, wherein at least one of the plurality of walls of the second housing portion includes a lower knockout, and wherein the lower knockout is selectively removable from the second housing portion.

10. The luminaire of claim 9, wherein the upper knockout and the lower knockout align to form a circular knockout when the first housing portion and the second housing portion are in the first configuration, and wherein the circular knockout is configured to receive a portion of a fitting to secure the fitting to the first and second housing portions.

11. The luminaire of claim 9, wherein the upper knockout and the lower knockout overlap when the first housing portion and the second housing portion are in the second configuration.

12. A luminaire comprising:

a first housing portion including an upper surface and a plurality of walls, at least one of the plurality of walls including a first knockout; and a second housing portion including a lower surface and a plurality of walls, the lower surface including a lens portion, at least one of the plurality of walls of the second housing portion including a second knockout, wherein the first housing portion and the second housing portion are selectively connectable to one another in a first configuration in which the first knockout is aligned with the second knockout to form a first knockout shape, and wherein the first housing portion and the second housing portion are selectively connectable to one another in a second configuration in which the first knockout overlaps with the second knockout to form a second knockout shape different than the first knockout shape.

13. The luminaire of claim 12, wherein the first knockout shape is a circular knockout, and wherein the circular knockout is configured to receive a portion of a fitting to secure the fitting to the upper and second housing portions.

14. The luminaire of claim 12, wherein the lower surface of the second housing portion is spaced apart from the upper surface of the first housing portion by a first distance while the first housing portion and the second housing portion are in the first configuration.

15. The luminaire of claim 14, wherein the lower surface of the second housing portion is spaced apart from the upper surface of the first housing portion by a second distance while the first housing portion and the second housing portion are in the second configuration, the second distance being different from the first distance.

16. The luminaire of claim 12, wherein the upper surface of the first housing portion includes at least one aperture sized to receive a fastener, and wherein the fastener is configured to secure the first housing portion to a surface of a cabinet independently from the second housing portion.

17. The luminaire of claim 16, wherein the fastener is pre-installed onto the first housing portion.

18. The luminaire of claim 12, wherein one of the plurality of walls of the first housing portion includes a plurality of apertures.

19. The luminaire of claim 18, wherein one of the plurality of walls of the second housing portion includes a plurality of protrusions, and wherein each of the plurality of protrusions is positioned within one of the plurality of apertures when the first housing portion and the second housing portion are in the first configuration and in the second configuration.

20. The luminaire of claim 19, wherein the plurality of apertures includes first apertures and second apertures, and wherein the second apertures are located between the first apertures and the upper surface of the first housing portion, and wherein the first housing portion and the second housing portion are positioned in the first configuration while each of the plurality of protrusions is positioned within one of the first apertures, and wherein the first housing portion and the second housing portion are positioned in the second configuration while each of the plurality of protrusions is positioned within one of the second apertures.

* * * * *